US011187003B2

(12) United States Patent
Pan et al.

(10) Patent No.: US 11,187,003 B2
(45) Date of Patent: Nov. 30, 2021

(54) FLOATING ROOF ASSEMBLY

(71) Applicant: JING KAI INDUSTRIAL CO., LTD., Kaohsiung (TW)

(72) Inventors: Wen-Pin Pan, New Taipei (TW); Shu-Wen Yen, New Taipei (TW)

(73) Assignee: JING KAI INDUSTRIAL CO., LTD., Kaohsiung (TW)

( * ) Notice: Subject to any disclaimer, the term of this patent is extended or adjusted under 35 U.S.C. 154(b) by 93 days.

(21) Appl. No.: 16/867,829

(22) Filed: May 6, 2020

(65) Prior Publication Data

US 2021/0207392 A1 Jul. 8, 2021

(30) Foreign Application Priority Data

Jan. 8, 2020 (TW) ..... 109100606

(51) Int. Cl.
*E04H 7/06* (2006.01)
*B65D 88/42* (2006.01)

(52) U.S. Cl.
CPC ..... *E04H 7/065* (2013.01); *B65D 88/42* (2013.01)

(58) Field of Classification Search
CPC ..... B65D 90/54; B65D 81/245; B65D 90/22; B65D 88/42; B65D 88/34; E04D 11/02; E04D 11/007; E04D 11/005; E04D 11/002; E04D 11/00; A62C 29/00; E04H 7/065
USPC ..... 220/216
See application file for complete search history.

(56) References Cited

U.S. PATENT DOCUMENTS 1,666,525 A * 4/1928 Bohnhardt ..... B65D 88/42 220/225
1,698,158 A * 1/1929 Glass ..... B65D 88/34 220/222
1,765,593 A * 6/1930 Kueffer ..... B65D 88/34 220/219
1,819,401 A * 8/1931 Bailey ..... B65D 88/34 220/218
1,897,779 A * 2/1933 Wiggins ..... B65D 88/38 220/219
3,134,501 A * 5/1964 Bodley ..... B65D 88/34 220/218

(Continued)

FOREIGN PATENT DOCUMENTS

CN 201439430 U 4/2010
EP 3466839 A1 4/2019
TW M418899 U 12/2011

OTHER PUBLICATIONS

Search Report appended to an Office Action, which was issued to Taiwanese counterpart application No. 109100606 by the TIPO dated May 22, 2020 with an English translation thereof.

*Primary Examiner* — Kareen K Thomas

(57) ABSTRACT

A floating roof assembly includes longitudinal girders, and floating members arranged in rows that alternate with the longitudinal girders. Upper and lower press bars are disposed across and fixed to the longitudinal girders. Each of the upper and lower press bars has fastening holes each of which has a first hole portion and a second hole portion. Fastening members connect the upper and lower press bars to the longitudinal girders through the fastening holes. When the fastening members reach the second hole portions of the upper and lower press bars, the longitudinal girders can increase a clamping force thereof to clamp the floating members.

8 Claims, 8 Drawing Sheets

(56) References Cited

U.S. PATENT DOCUMENTS

| | | | | | |
|---|---|---|---|---|---|
| 3,228,702 | A * | 1/1966 | Ulm | B65D 88/48 | 277/583 |
| 3,294,372 | A * | 12/1966 | Davis | B65D 88/34 | 366/270 |
| 3,690,502 | A * | 9/1972 | Guber, Jr. | B65D 88/34 | 220/219 |
| 4,116,356 | A * | 9/1978 | Silver, Jr. | B65D 90/00 | 220/216 |
| 4,130,216 | A * | 12/1978 | Creith | B65D 88/46 | 220/222 |
| 2012/0018178 | A1* | 1/2012 | Stambaugh | A62C 3/065 | 169/46 |
| 2017/0305657 | A1* | 10/2017 | Imhof | B65D 90/28 | |
| 2019/0106275 | A1 | 4/2019 | Weng et al. | | |

* cited by examiner

FLOATING ROOF ASSEMBLY

CROSS-REFERENCE TO RELATED APPLICATION

This application claims priority to Taiwanese Patent Application No. 109100606, filed on Jan. 8, 2020.

FIELD

The disclosure relates to a floating roof assembly used in a fluid storage tank.

BACKGROUND

Volatile organic compounds (VOCs) come from petroleum oil stored in a fluid storage tank. When concentrations of the VOCs in the fluid storage tank are excessively increased, the VOCs are liable to cause a flashover or an explosion due to heat, static electricity or a lightning strike. The excessive VOCs can harm human health. In order to address these problems, an inner floating roof has been used in the art to be placed atop a fluid body in an oil storage tank. The inner floating roof contacts and floats on a liquid surface of the fluid body to prevent air from contacting the liquid body, thereby reducing VOC evaporation from the fluid body.

FIGS. 1 and 2 illustrate an inner floating roof 1 including a plurality of longitudinal floating members 11. Each longitudinal floating member 11 is composed of top and bottom plates 111 and a honeycomb core 112 adhesively connected between the top and bottom plates 111 so that each longitudinal floating member 11 is of lightweight and has a strong structure. In addition, the inner floating roof 1 further includes multiple clamping boards 12 each interconnecting two longitudinal floating members 11. Each clamping board 12 is composed of upper and lower parts connected to each other in an interlocking manner (not shown) to form a structure of I-shaped cross section having two clamping recesses 121 that open in opposite directions. The two clamping recesses 121 respectively clamp widthwise ends of two adjacent ones of the longitudinal floating members 11. As each clamping recess 121 clamps only one of two opposite widthwise ends of one of the longitudinal floating members 11, the longitudinal floating members 11 are easily loosened. In addition, as the lengthwise ends of the longitudinal floating member 11 are not clamped, the top and bottom plates 111 thereof are prone to warp at the lengthwise ends thereof. Consequently, fluids may intrude into the honeycomb core 112 and impair the effect of the adhesives used in adhering the honeycomb cores 112 to the top and bottom plates 111.

SUMMARY

Therefore, an object of the disclosure is to provide a floating roof assembly that is not only robust but also easy to assemble and dissemble.

According to the disclosure, a floating roof assembly includes a plurality of longitudinal girders, a plurality of floating members, a plurality of spaced-apart upper press bars and lower press bars, and a plurality of fastening members.

The longitudinal girders are spaced apart from each other. Each of the longitudinal girders has girder top and bottom sides extending in a lengthwise direction thereof, a top slide groove formed in and opening upwardly at the girder top side, and a bottom slide groove formed in and opening downwardly at the girder bottom side. The top and bottom slide grooves extend in the lengthwise direction.

The floating members are arranged in longitudinal rows that alternate with the longitudinal girders. Each row of the floating members is clamped between two of the longitudinal girders.

Each of the upper press bars is disposed across and fixed to the girder top sides of adjacent two of the longitudinal girders to place the two of the longitudinal girders in a clamping position. Each of the lower press bars is disposed across the girder bottom sides of adjacent two of the longitudinal girders to place the two of the longitudinal girders in a clamping position. Each of the upper and lower press bars has a plurality of fastening holes.

The fastening members connect the upper and lower press bars to the longitudinal girders. Each of the fastening members includes a bolt, and a nut engaged with the bolt. Each of the fastening members is slidably attached to one of the girder top and bottom slide grooves of one of the longitudinal girders and one of the fastening holes of one of the upper and lower press bars.

Each of the fastening holes is an elongated hole that has a first hole portion, and a second hole portion. Each of the fastening members is able to transition from the first hole portion to the second hole portion. When the fastening members respectively reach corresponding the second hole portions in a corresponding one of the upper and lower press bars, corresponding two of the longitudinal girders can have an increased clamping force.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
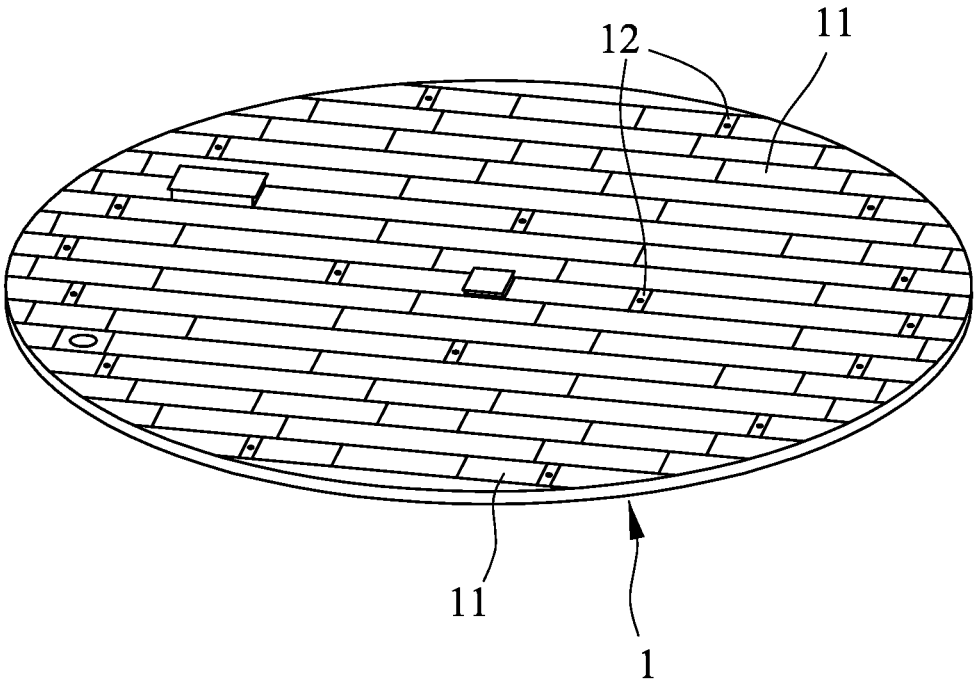
FIG.1 PRIOR ART
FIG. 1 is a perspective view of an existing inner floating roof.
Figure 2:
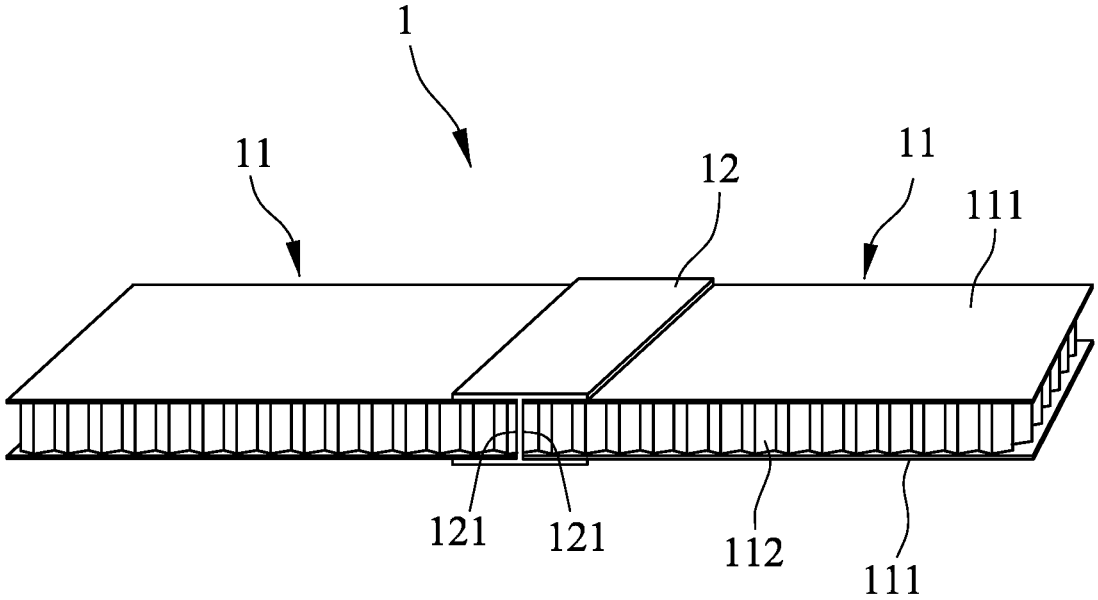
FIG.2 PRIOR ART
FIG. 2 is a perspective view illustrating two floating members and a clamping board of the existing inner floating roof.
Figure 3:
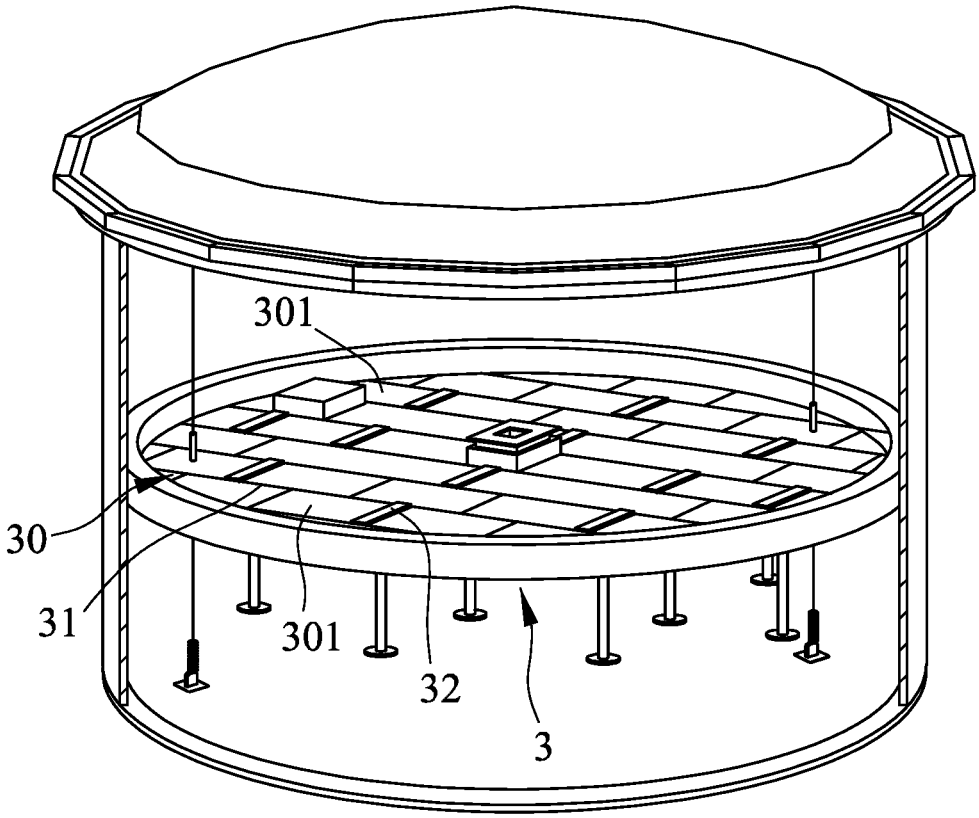
FIG. 3 shows a fluid tank incorporating a floating roof assembly according to an embodiment of the disclosure.
Figure 4:
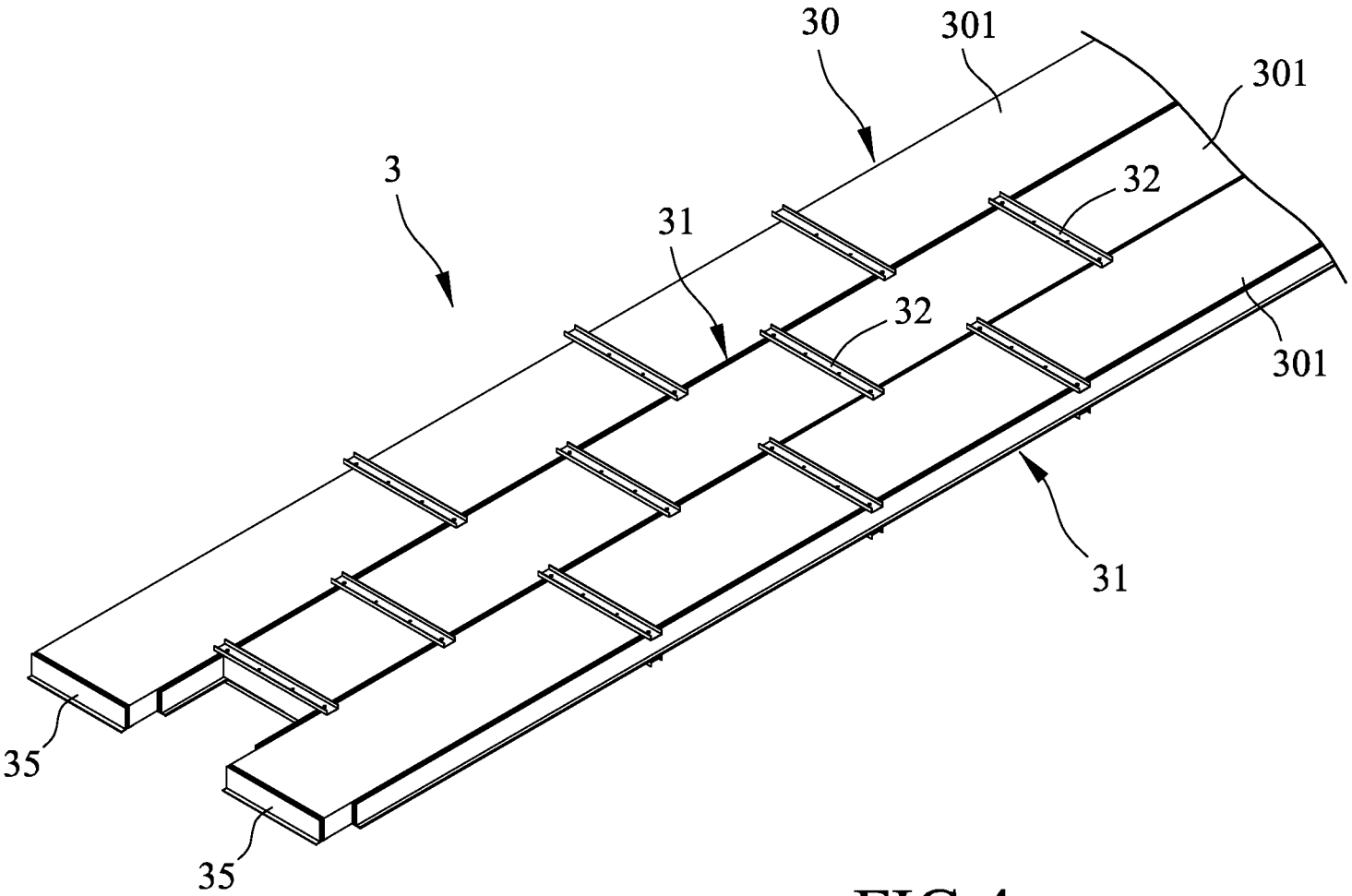
FIG. 4 is a fragmentary perspective view illustrating longitudinal girders, floating members, and upper and lower press bars of the embodiment.
Figure 5:
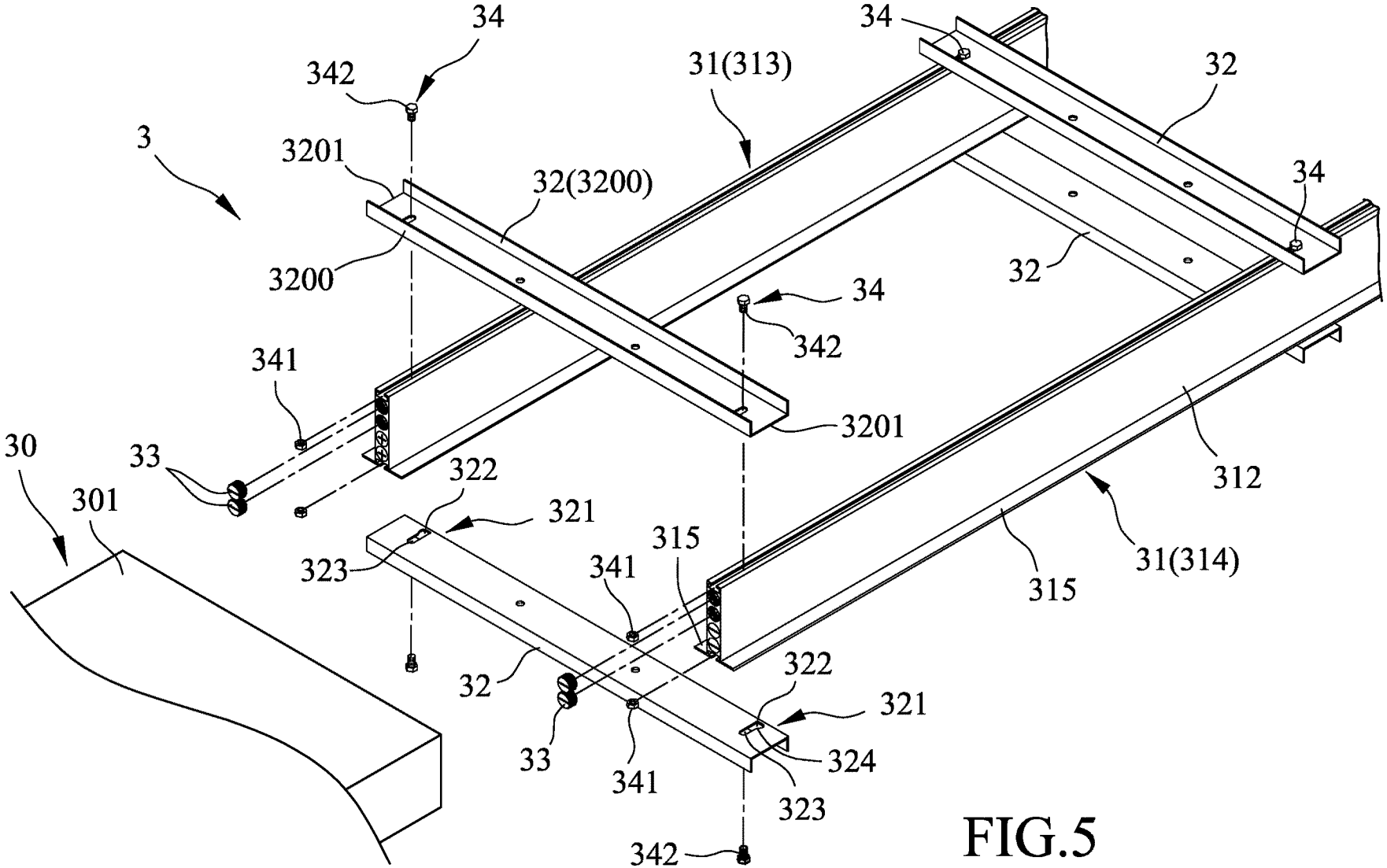
FIG. 5 is fragmentary exploded perspective view illustrating a floating member, two longitudinal girders, upper and lower press bars, fastening members and sealing members of the embodiment.

FIGS. 3 to 5 illustrate a floating roof assembly 3 according to an embodiment of the disclosure. The floating roof assembly 3 includes a plurality of longitudinal girders 31, a floating unit 30, a plurality of spaced-apart upper press bars 32 and lower press bars 32, multiple sealing members 33, and a plurality of fastening members 34

Figure 6:
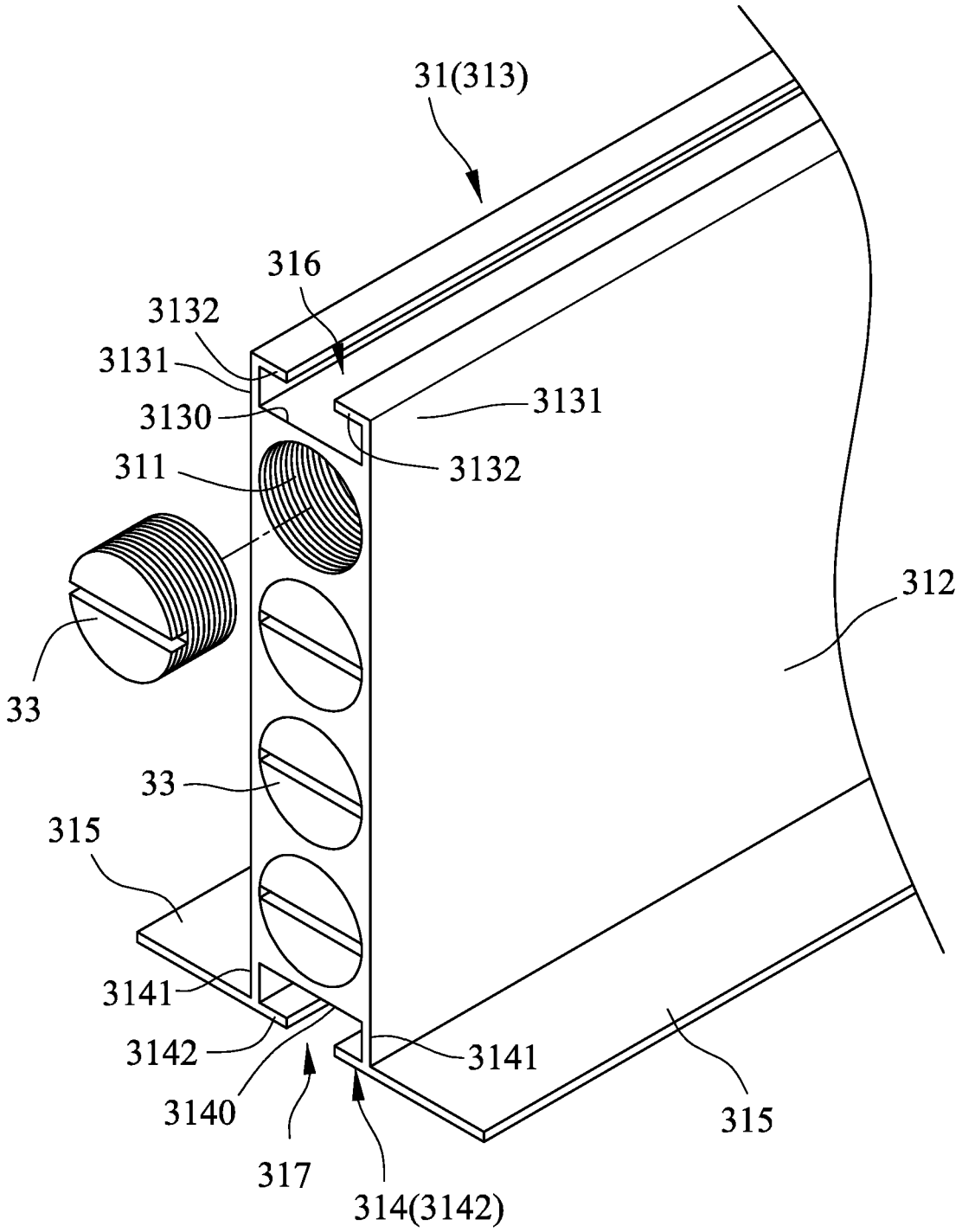
FIG. 6 is a fragmentary perspective view illustrating the longitudinal girder and the sealing members of the embodiment.

Referring to FIG. 6, in combination with FIGS. 4 and 5, the longitudinal girders 31 are spaced apart from each other. Each of the longitudinal girders 31 has a main body portion 312 extending longitudinally in a lengthwise direction thereof and having girder top and bottom sides 313, 314, and two support plate portions 315 respectively projecting sidewards in opposite directions from the girder bottom side 314. Each longitudinal girder 31 further has a top slide groove 316 formed in the girder topside 313 and opening upwardly at the girder top side 313, and a bottom slide groove 317 formed in and opening downwardly at the girder bottom side 314.

In this embodiment, the main body portion 312 further has a plurality of through channels 311 extending in the lengthwise direction and each opening at two ends of the main body portion 312 that are opposite in the lengthwise direction. By virtue of the through channels 311, each longitudinal girder 31 can be reduced in weight.

The top slide groove 316 is defined by a top groove-bottom 3130 formed at the girder top side 313, two top groove walls 3131 facing each other and connected to the top groove-bottom 3130, and two top flanges 3132 projecting respectively from the top groove walls 3131 distally from the top groove-bottom 3130 and extending toward each other. The top slide groove 316 is narrowed between the top flanges 3132. The bottom slide groove 317 is defined by a bottom groove-bottom 3140 formed at the girder bottom side 314, two bottom groove walls 3141 facing each other and connected to the bottom groove-bottom 3140, and two bottom flanges 3142 projecting respectively from the bottom groove walls 3141 distally from the bottom groove-bottom 3140 and extending toward each other. The bottom slide groove 317 is narrowed between the bottom flanges 3142.

The floating unit 30 includes a plurality of floating members 301 each of which has, but not limited hereto, a honeycomb structure. The floating members 301 are arranged in longitudinal rows that alternate with the longitudinal girders 31. Each row of the floating members 301 is clamped between two of the longitudinal girders 31.

Figure 7:
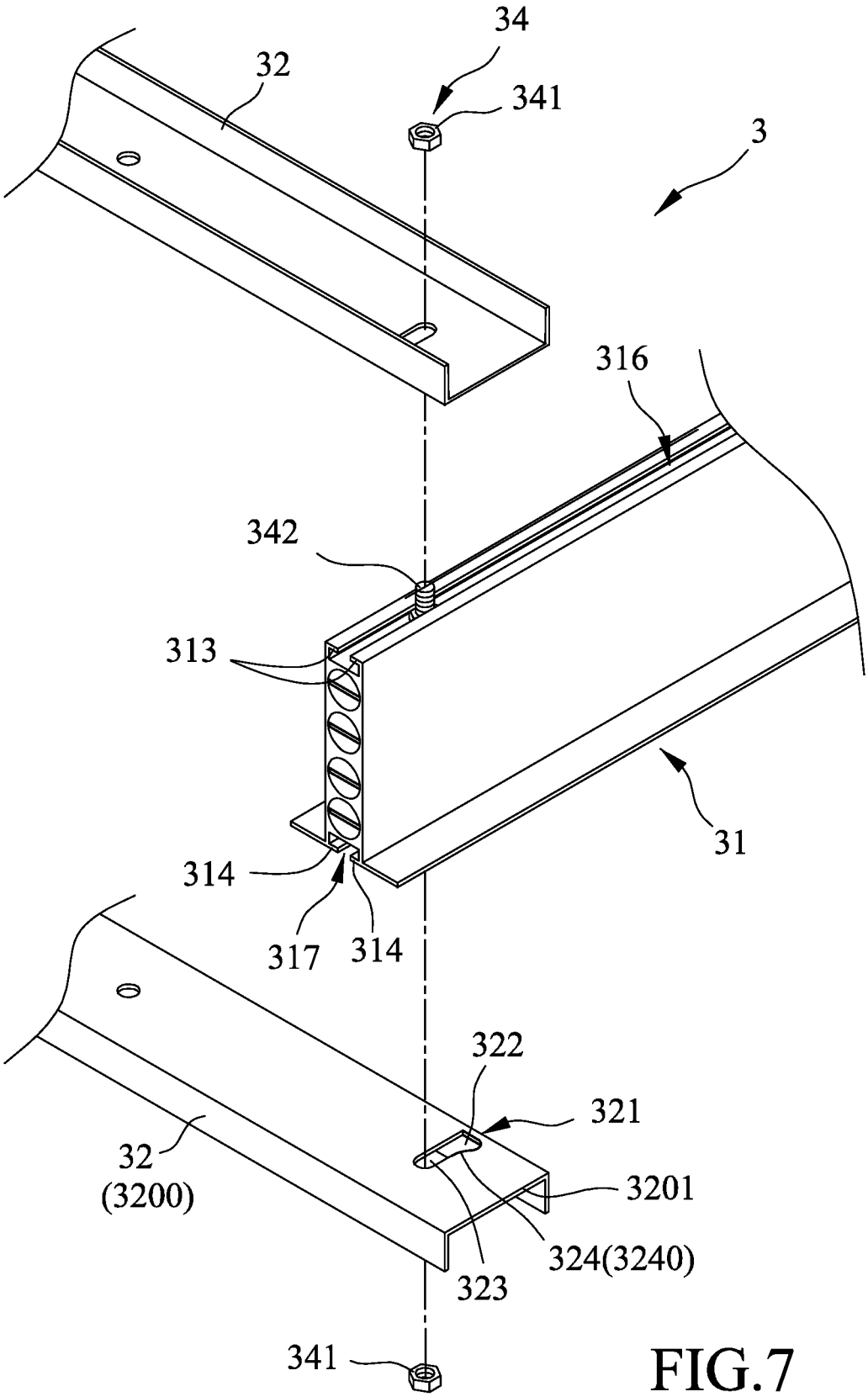
FIG. 7 is a fragmentary perspective view illustrating the upper and lower press bards assembled to the longitudinal girder by the fastening members of the embodiment.

Each of upper and lower press bars 32 has a U-shaped cross section for enhancement of structural strength. Each upper press bar 32 is disposed across and fixed to the girder top sides 313 of adjacent two longitudinal girders 31 to place the two longitudinal girders 31 in a clamping position. Each lower press bars 32 is disposed across the girder bottom sides 314 of adjacent two longitudinal girders 31 to place the two longitudinal girders 31 in a clamping position. Each of the upper and lower press bars 32 has a plurality of fastening holes 321. In this embodiment, each of the upper and lower press bars 32 has two opposite bar lengthwise ends 3200, and two opposite bar widthwise ends 3201. Each of the fastening holes 321 is proximal to one of the bar widthwise ends 3201 and is an elongated hole that has a first hole portion 322, and a second hole portion 323. The elongated hole of each of the fastening holes 321 extends transversely of the bar lengthwise ends 3201. As shown in FIG. 7, the first hole portion 322 is proximal to one of the bar lengthwise ends 3200. The second hole portion 323 is distal from said one of the bar lengthwise ends 3200. The first hole portion 322 is more proximal to the corresponding one of the bar widthwise ends 3201 than the second hole portion 323. In addition, each of the fastening holes 321 further has a hole boundary edge 324 bounding the first and second hole portions 322, 323. The hole boundary edge 324 has a curved edge portion 3240 that extends from the first hole portion 322 to the second hole portion 323 through a junction of the first and second hole portions 322, 323.

As shown in FIGS. 5 and 6, each of the through channels 311 of each longitudinal girder 31 has two openings respectively formed at the two ends of the main body portion 312. Each pair of the sealing members 33 respectively seal the openings of one of the through channels 311 to prevent liquid from entering one of the through channels 311. The sealing members 33 in this embodiment are screws and are screwed into the respective openings of the through channels 311. Alternatively, the sealing members 33 may have other forms that can be plugged into, or engaged with the openings of the through channels 311. Therefore, the floating capability of each longitudinal girder 31 is increased.

The fastening members 34 connect the upper and lower press bars 32 to the longitudinal girders 31. Each of the fastening members 34 is able to transition from the first hole portion 322 to the second hole portion 323 by sliding along the curved edge portion 324. In addition, each fastening member 34 includes a bolt 342, and a nut 341 engaged with the bolt 342. Each of the fastening members 34 is slidably attached to one of the girder top and bottom slide grooves 316, 317 of one of the longitudinal girders 31 and one of the fastening holes 321 of one of the upper and lower press bars 32. In this embodiment, the nut 341 of each of the fastening members 34 is positioned in one of the top and bottom slide grooves 316, 317 of a corresponding one of the longitudinal girders 31. The top groove walls 3131 or the bottom groove walls 3141 prevent rotation of, but allow sliding of the nut 341 in one of the top and bottom slide grooves 316, 317. The bolt 342 of each of the fastening members 34 extends through one of the fastening holes 321 of a corresponding one of the upper and lower press bars 32 and has a bolt head to tightly abut the corresponding one of the upper and lower press bars 32 when the bolt 342 engages with the nut 341.

Referring back to FIGS. 3 and 4, the floating roof assembly 3 further includes a plurality of end plates 35 each extending transversely to the longitudinal girders 31. Each end plate 35 connects an outmost ends of one of the floating members 301 clamped between two longitudinal girders 31 for reinforcement.

Referring to FIG. 7, in another embodiment, the bolt 342 of each of the fastening members 34 extends through one of the fastening holes 321 of a corresponding one of the upper and lower press bars 32, and the bolt head of the bolt 342 is positioned in one of the top and bottom slide grooves 316, 317 of a corresponding one of the longitudinal girders 31. The nut 341, which engages the bolt 342, tightly abuts the corresponding one of the upper and lower press bars 32. The top groove walls 3131 or the bottom groove walls 3141 prevent rotation of, but allow sliding of the bolt head in one of the top and bottom slide grooves 316, 317.

Figure 8A:
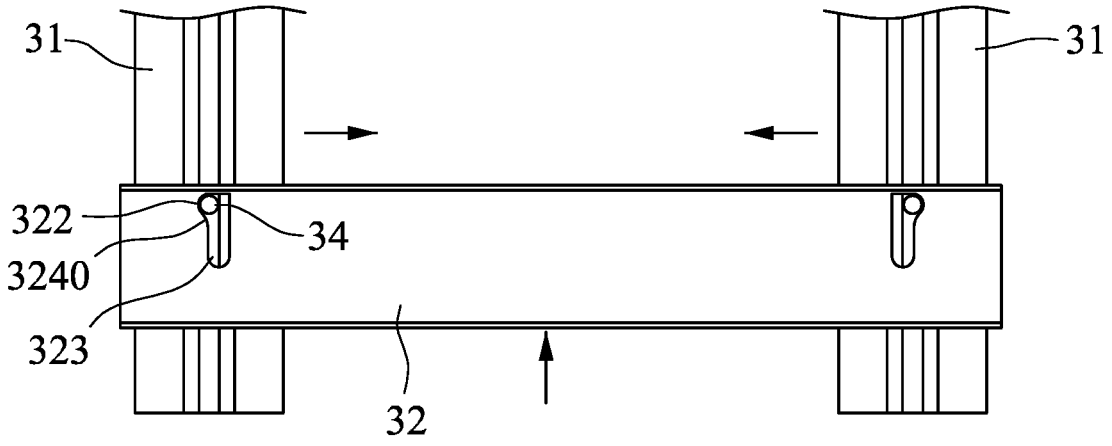
FIGS. 8A and 8B illustrate how a fastening hole of the upper or lower press bar interacts with the corresponding fastening member for increasing a clamping force of two longitudinal girders.
Figure 8B:
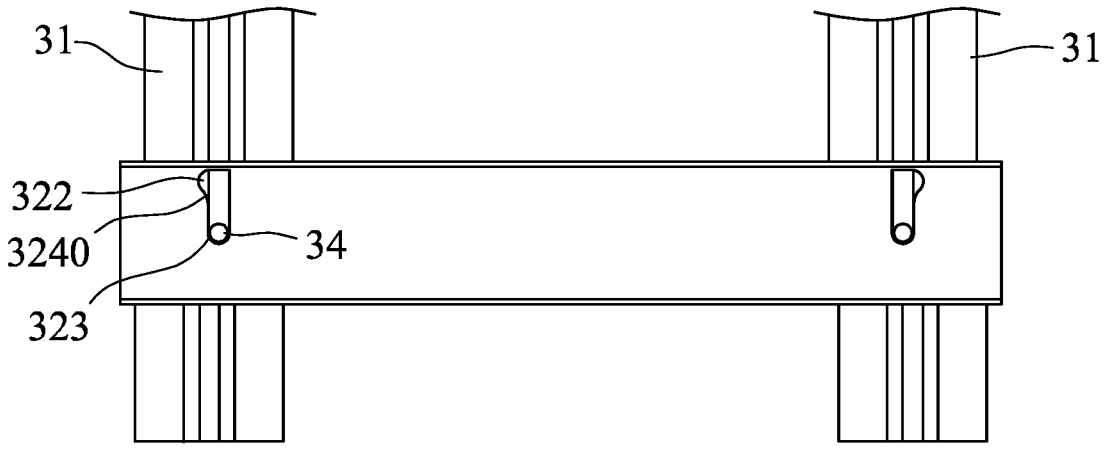

In use, one of the two support plate portions 315 of each of the longitudinal girders 31 extends below and abuts an adjacent row of the floating members 301. Therefore, each row of the floating members 301 clamped between two of the longitudinal girders 31 are supported on one of the two support plate portions 315 of each of the two of the longitudinal girders 31. The upper and lower press bars 32 abut top and bottom sides of the corresponding row of the floating members 301 to position the corresponding row of the floating members 301. As shown in FIG. 8A, at an initial state, two fastening members 34 are respectively situated in the first hole portions 322 of the fastening holes 321 of the corresponding upper or lower press bar 32. After the fastening members 42 are tightened, the upper or lower press bars 32 are pushed to slide relative to the longitudinal girders 31 until the fastening members 34 reach the respective second hole portions 323 as shown in FIG. 8B. During the sliding of the upper or lower press bars 32, the fastening members 34 slide along the curved edge portions 3240 of the respective fastening holes 321 so that the corresponding two longitudinal girders 31 move toward each other, thereby increasing the clamping force thereof to clamp the floating members 301 therebetween.

Because the upper or lower press bars 32 are movable relative to the longitudinal girders 31, they can be disposed at different positions of the floating members 301 for providing an improved and stable securing effect for the floating members 301. The supporting ability for the floating members 301 is also increased due to the provision of the support plate portions 315 at the bottom sides of the longitudinal girders. The number and location of the upper and lower press bars 32 can be adjusted to provide the floating roof assembly with a firm and tight flat structure that is almost entirely planar.

When one of the floating members 301 is required to be removed/replaced, it is only required that the corresponding fastening members 34 are loosened to detach the corresponding upper press bar(s) 32 for individual removal of the floating member 301. It is not necessary to detach the lower press bars 32, thereby reducing working time, and facilitating replacement and maintenance.

To sum up, the floating roof assembly 3 can be quickly assembled, and the floating members 301 can be replaced individually and easily. In addition, the clamping forces for the floating members 301 are adjustable, the securing effect for the floating members 301 is superior, and the risk of warping and bulging of the floating members 301 is avoided.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A floating roof assembly, comprising:

a plurality of longitudinal girders spaced apart from each other, each of said longitudinal girders having girder top and bottom sides extending in a lengthwise direction thereof, a top slide groove formed in and opening upwardly at said girder top side, and a bottom slide groove formed in and opening downwardly at said girder bottom side, said top and bottom slide grooves extending in the lengthwise direction;

a plurality of floating members arranged in longitudinal rows that alternate with said longitudinal girders, each row of said floating members being clamped between two of said longitudinal girders;

a plurality of spaced-apart upper press bars and lower press bars, each of said upper press bars being disposed across and fixed to said girder top sides of adjacent two of said longitudinal girders to place said two of said longitudinal girders in a clamping position, each of said lower press bars being disposed across said girder bottom sides of adjacent two of said longitudinal girders to place said two of said longitudinal girders in a clamping position, each of said upper and lower press bars having a plurality of fastening holes; and a plurality of fastening members connecting said upper and lower press bars to said longitudinal girders, each of said fastening members including a bolt, and a nut engaged with said bolt, each of said fastening members being slidably attached to one of said girder top and bottom slide grooves of one of said longitudinal girders and one of said fastening holes of one of said upper and lower press bars, each of said fastening holes being an elongated hole that has a first hole portion, and a second hole portion, each of said fastening members being able to transition from said first hole portion to said second hole portion, whereby, when said fastening members respectively reach corresponding said second hole portions in a corresponding one of said upper and lower press bars, corresponding two of said longitudinal girders can have an increased clamping force.

2. The floating roof assembly as claimed in claim 1, wherein each of said upper and lower press bars has two opposite bar lengthwise ends, and two opposite bar widthwise ends, each of said fastening holes being proximal to one of said bar widthwise ends, said elongated hole of each of said fastening holes extending transversely of said bar lengthwise ends, said first hole portion being proximal to one of said bar lengthwise ends, said second hole portion being distal from said one of said bar lengthwise ends, said first hole portion being more proximal to the corresponding one of said bar widthwise ends than said second hole portion, each of said fastening holes further having a hole boundary edge bounding said first and second hole portions, said hole boundary edge having a curved edge portion that extends from said first hole portion to said second hole portion through a junction of said first and second hole portions, each of said fastening members transitioning from said first hole portion to said second hole portion by sliding along said curved edge portion.

3. The floating roof assembly as claimed in claim 1, wherein:

each of said longitudinal girders further has a main body portion extending longitudinally and having said girder top and bottom sides, and two support plate portions respectively projecting sidewards in opposite directions from said girder bottom side;

one of said two support plate portions extends below and abuts an adjacent row of said floating members.

4. The floating roof assembly as claimed in claim 3, wherein said main body portion further has a plurality of through channels extending in the lengthwise direction and each opening at two ends of said main body portion that are opposite in the lengthwise direction.

5. The floating roof assembly as claimed in claim 4, further comprising multiple sealing members, each of said through channels having two openings respectively formed at said two ends of said main body portion, each pair of said sealing members respectively sealing said openings of one of said through channels.

6. The floating roof assembly as claimed in claim 3, wherein said top slide groove of each of said longitudinal girders is defined by a top groove-bottom formed at said girder top side, two top groove walls facing each other and connected to said top groove-bottom, and two top flanges projecting respectively from said top groove walls distally from said top groove-bottom and extending toward each other, said top slide groove being narrowed between said top flanges, said bottom slide groove of each of said longitudinal girders being defined by a bottom groove-bottom formed at said girder bottom side, two bottom groove walls facing each other and connected to said bottom groove-bottom, and two bottom flanges projecting respectively from said bottom groove walls distally from said bottom groove-bottom and extending toward each other, said bottom slide groove being narrowed between said bottom flanges.

7. The floating roof assembly as claimed in claim 1, wherein said nut of each of said fastening members is positioned in one of said top and bottom slide grooves of a corresponding one of said longitudinal girders, said bolt of each of said fastening members extending through one of said fastening holes of a corresponding one of said upper and lower press bars and having a bolt head tightly abutting the corresponding one of said upper and lower press bars.

8. The floating roof assembly as claimed in claim 1, wherein said bolt of each of said fastening members extends through one of said fastening holes of a corresponding one of said upper and lower press bars and has a bolt head positioned in one of said top and bottom slide grooves of a corresponding one of said longitudinal girders, said nut of each of said fastening members tightly abutting the corresponding one of said upper and lower press bars.

* * * * *